United States Patent [19]

Goodson, Jr.

[11] Patent Number: 4,514,950

[45] Date of Patent: May 7, 1985

[54] BUILDING FRAMING SYSTEM AND METHOD

[76] Inventor: Albert A. Goodson, Jr., 13923 Myrtlea, Houston, Tex. 77079

[21] Appl. No.: 325,283

[22] Filed: Nov. 27, 1981

[51] Int. Cl.[3] ..... E04H 12/00

[52] U.S. Cl. ..... 52/648; 52/633; 52/645

[58] Field of Search ..... 52/93, 263, 296, 298, 52/280, 648, 654 S, 697, 650, 745, 747, 633; 21/191; 108/109

[56] References Cited

U.S. PATENT DOCUMENTS

| | | | |
|---|---|---|---|
| 1,808,082 | 6/1931 | Thompson | 52/298 X |
| 1,818,418 | 8/1931 | Millard | 52/648 X |
| 1,988,388 | 1/1935 | Mioton | 52/280 X |
| 2,067,403 | 1/1937 | Lea | 52/489 X |
| 2,610,710 | 9/1952 | Shannon | 52/298 X |
| 2,675,895 | 4/1954 | Loewenstein | 52/648 X |
| 3,218,775 | 11/1965 | Jackson | 52/650 |
| 3,791,089 | 2/1974 | Alderman | 52/647 X |
| 3,846,944 | 11/1974 | Lambert | 52/654 X |
| 4,074,487 | 2/1978 | Daniels et al. | 52/263 X |

FOREIGN PATENT DOCUMENTS

| | | | |
|---|---|---|---|
| 164605 | 6/1955 | Australia | 52/633 |
| 375240 | 8/1921 | Fed. Rep. of Germany | 52/650 |

OTHER PUBLICATIONS

Sweet's Catalog 1977, v. 2, 5.3/wh, p. 5.

AISC Manual of Steel Construction, 5th Ed., 1947, p. 263.

*Primary Examiner*—Henry E. Raduazo

*Attorney, Agent, or Firm*—David Alan Rose; David S. Wise

[57] ABSTRACT

A building framing system consisting of a plurality of framing units each having at least two vertical load bearing column/studs with one or more joists extending horizontally there between and bolted in place. The joists are vertically spaced apart a distance sufficient for one floor of the building which may have as many as twelve floors. The frame units are erected in parallel, spaced apart a considerable distance and are connected together by means of spacer members and diagonal braces which are provided at each end and at each floor.

8 Claims, 16 Drawing Figures

Fig. 5
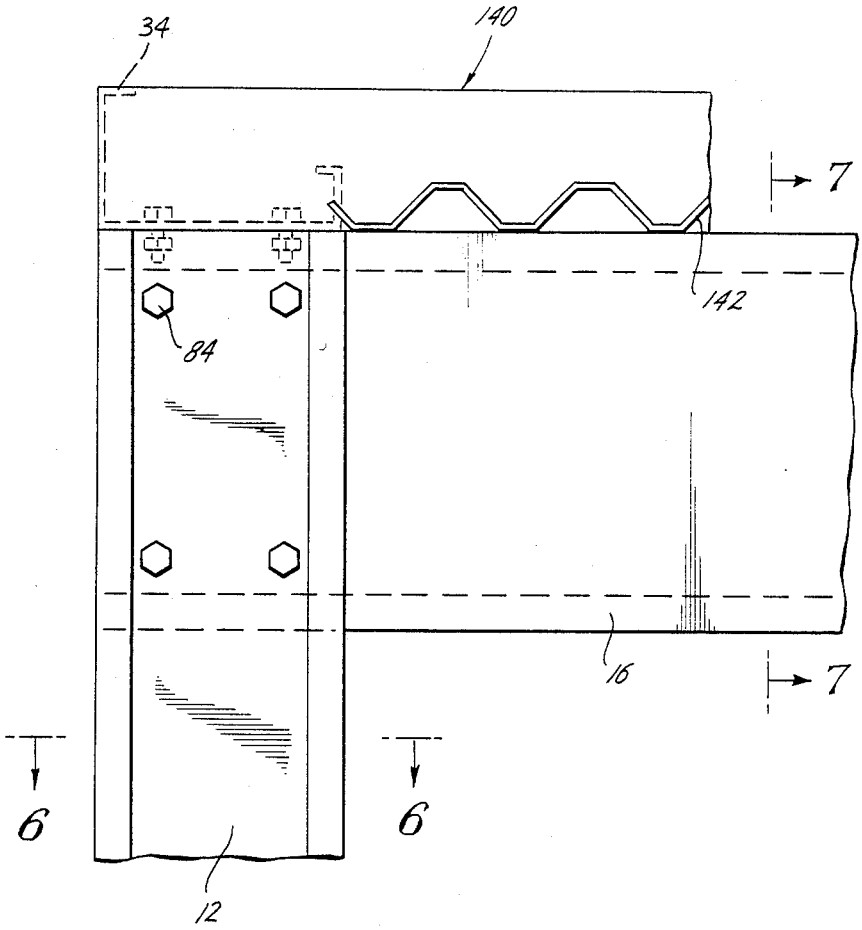
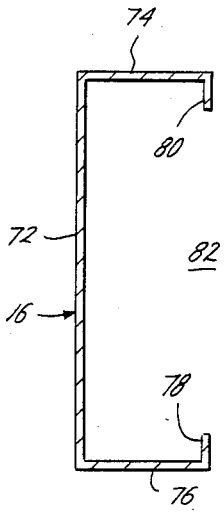
Fig. 7
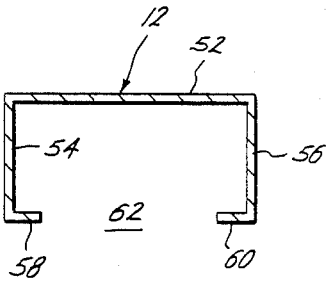
Fig. 6

Fig. 8
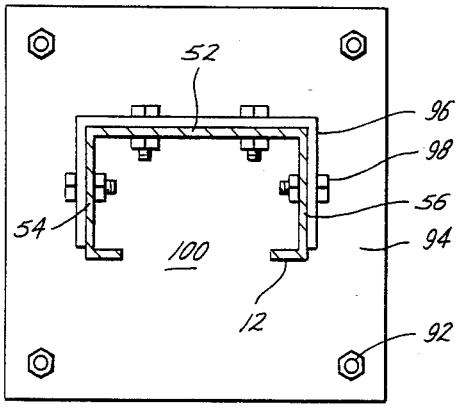
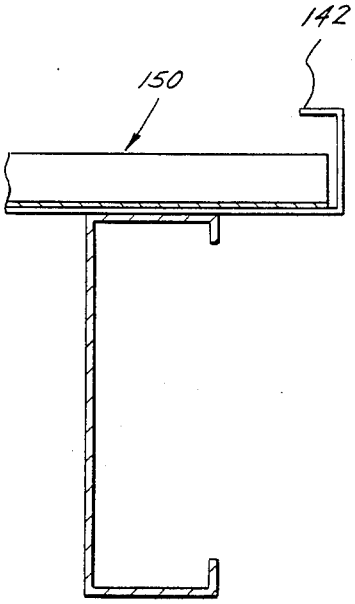
Fig. 13
Fig. 9
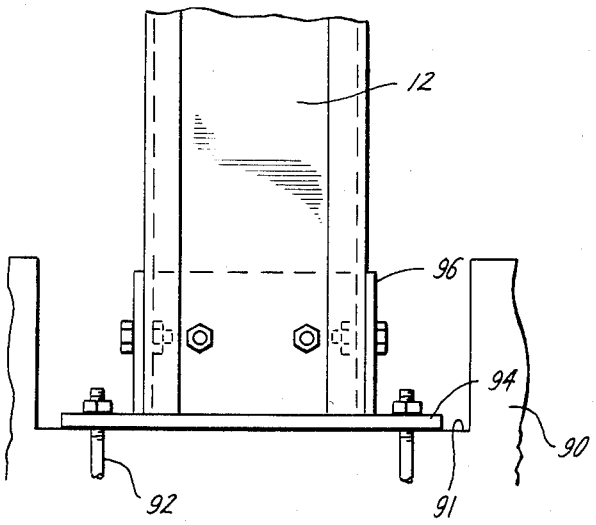

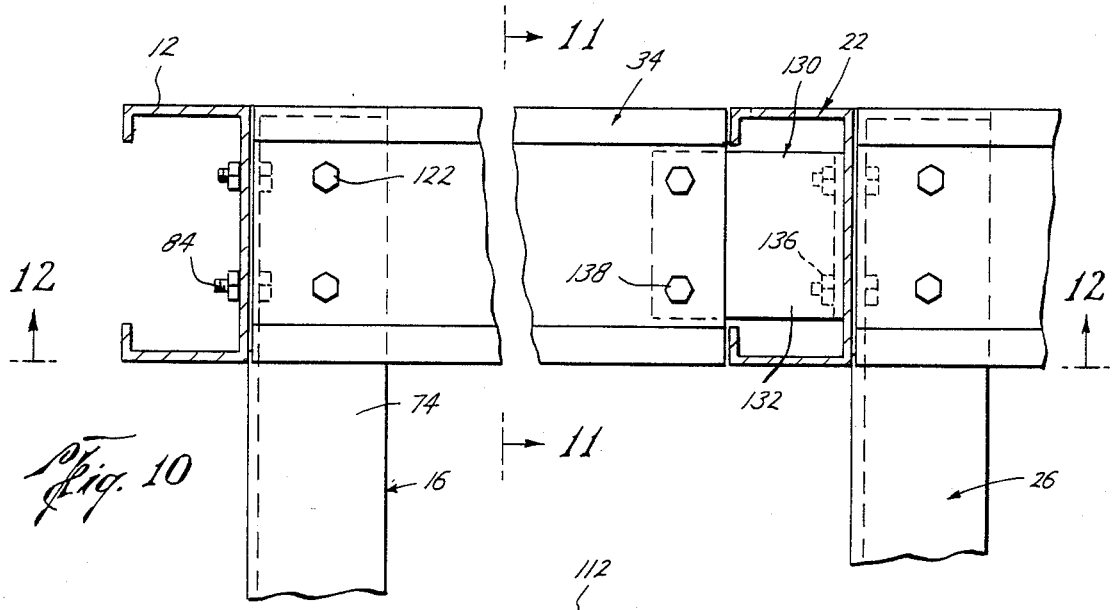
Fig. 10
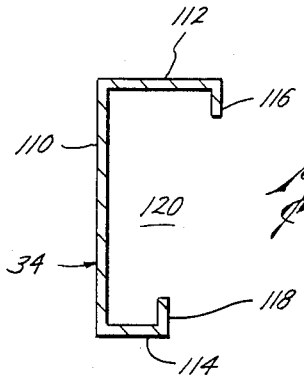
Fig. 11
Fig. 12
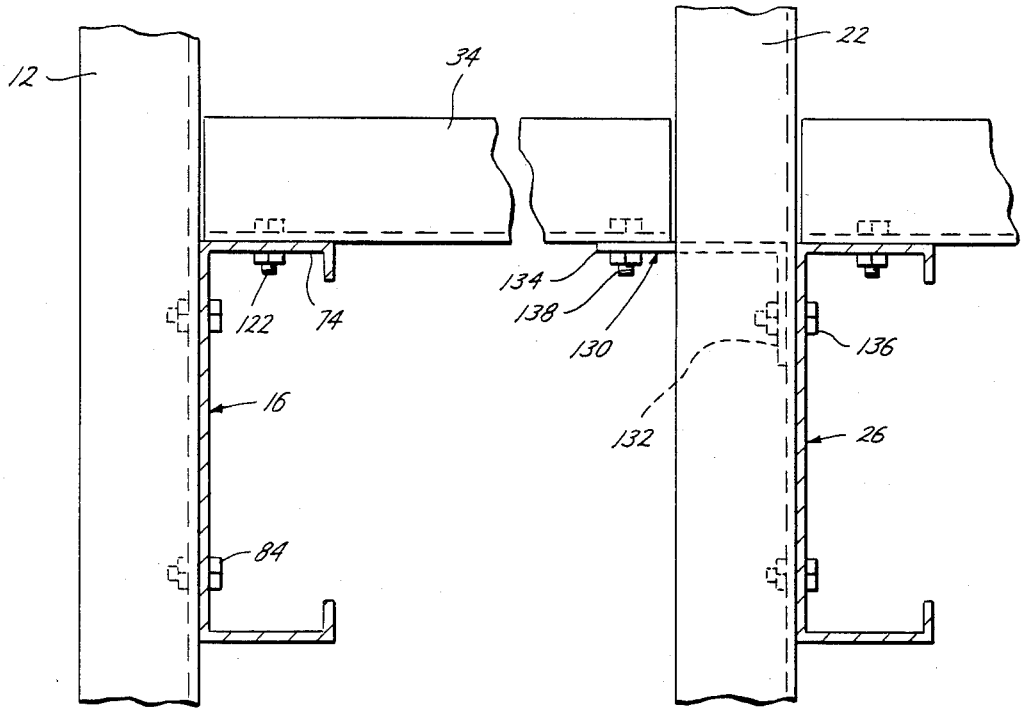

BUILDING FRAMING SYSTEM AND METHOD

FIELD OF INVENTION

This invention relates to building framing systems for single story and multi-story buildings, and more particularly, to modular systems employing a plurality of metal framing members.

DESCRIPTION OF THE PRIOR ART

A long time objective of the construction industry is to provide prefabricated buildings which can be assembled and erected quickly and economically with a minimum of on-site labor. Many different designs of prefabricated buildings and methods for their assembly are disclosed in the prior art. Generally, such designs are one of two types. The first is the conventional column and beam steel construction which includes metal frame units connected together to form prefabricated or modular buildings with each frame unit consisting of vertical columns, non-axial loaded studs, horizontal beams and horizontal open web joists. The vertical columns generally are steel beams with an I-shape or H-shape, depending on flange size, or are pipe. The horizontal beams are generally I-shaped steel. The studs are cold formed metal channels or Cees and the joists are open web steel joists. The other design type is the light stud and joist framing system which entails the use of cold formed studs and cold formed joists in which the studs and joists are spaced close together (16" to 24") and each floor rests on top of the joists of the floor below. There are horizontal headers for windows and door openings in the wall structure.

For example, U.S. Pat. No. 3,304,675 shows the successive erection of load bearing frame structures consisting of vertical columns and innerconnecting horizontal joists without additional studs or cross members in between. The load bearing vertical columns are of a composite structure. U.S. Pat. No. 3,474,580 shows a series of metal frames consisting of vertical columns innerconnected by horizontal steel lattice beams. The beams are structurally different from the vertical columns. U.S. Pat. No. 3,717,964 shows a series of generally rectangular metal frames displaying a great number of vertical studs without horizontal bridging joints. U.S. Pat. No. 4,005,556 teaches the use of a plurality of building frames wherein vertical columns are connected by means of complex lattice work structures at the top and bottom. U.S. Pat. No. 4,130,970 discloses the use of prefabricated wall units for single or upper floor housing structures. The wall frames are equipped with a number of load bearing studs between the corner columns.

Various frame structures in the prior art include vertical columns having innerconnecting horizontal joists without intervening studs, such as in U.S. Pat. No. 3,304,675. The '675 patent shows the use of a vertical column having the same height as the constructed building. The '675 patent and U.S. Pat. Nos. 3,474,580 and 3,717,964 illustrate multi-storied units. The '580 and '964 patents show a series of metal frames connected together by beams.

It is well known in the art to have various preassembled portions of the building. For example, U.S. Pat. No. 1,849,273 and 4,005,556 teach preassembled frames or units. U.S. Pat. No. 4,130,970 shows prefabricated wall sections. U.S. Pat. No. 3,717,964 teaches a preassembled module. The '556 patent illustrates a preassembled frame with cross beams. Preassembled panels are taught in U.S. Pat. No. 3,304,675.

Various shaped cross-sectioned steel has been used for construction purposes. Vertical studs may be C-shaped or channel sectioned steel as shown in U.S. Pat. Nos. 383,170; 3,304,675; 3,717,964; 4,074,487; 4,130,970 and the Wheeling Corrugating Company brochure entitled "Wheeling Steel Framing, The New CostCutting System" No. 5.3/Wh. U.S. Pat. Nos. 3,304,675 and 4,074,487 show joists having a Z-shaped cross section.

Various types of flanges have been used to connect construction members as shown in U.S. Pat. Nos. 744,194; 3,304,675; 3,717,964; and 4,005,556. An angle iron flange is shown in U.S. Pat. No. 4,074,487. U.S. Pat. Nos. 1,818,418 and 3,717,964 show prepunched flanges. Channel section members have been shown to be affixed by nails or bolts through their transverse web as for example in U.S. Pat. Nos. 383,170; 4,074,487; and 4,130,970. Flange and bolt connections are used in U.S. Pat. Nos. 3,304,675 and 4,074,487 to anchor vertical columns to concrete foundations.

Upon completion of the construction of the frame, U.S. Pat. Nos. 3,304,675 and 4,005,556 teach the application of compressed chip board, plaster board, plywood, and gypsum board to the frame to complete the exterior and interior of the building. U.S. Pat. No. 4,074,487 teaches the use of corrugated steel for flooring.

Other patents showing the general state of the art include U.S. Pat. Nos. 1,423,375; 1,915,023; 2,232,510; 2,445,491; 3,000,061; 3,168,793; 3,225,434; 3,416,273; 3,638,380; 3,744,193; 3,818,671; 3,823,520; 3,846,944; 3,862,534; 3,971,172; 4,059,931; 4,073,104; and 4,102,097.

A variety of deficiencies are found in the prior art systems. Many prior art framing systems are limited to single story buildings and do not permit the direct attachment of standard finish collateral materials. Where in the prior art a joist supports more than one floor, web stiffeners are required at the ends of the joists. In multistory buildings, the plumbing and alignment of the complete frame is much more cumbersome when each frame system stops at each floor.

The assembly of prior art building frames does not permit the simultaneous work of various crafts. Most prior art systems require extended construction time, thus leaving them susceptible to the adverse effects of weather. Often prior art systems cannot be assembled at ground level and must be installed by workmen located at various levels in the building. Where prior art systems require an assembly on a piece-by-piece basis, extensive labor and crane time are required. Work performed at higher elevation requires more time and greater skilled labor.

Where component parts are not modular and are individually unique, the design of the component parts themselves requires extensive time and skilled labor and often requires an excessive amount of steel for the building.

Often, in many prior art systems, the spacing of the primary structural members, the depth of the structural member, the thickness of the web, the spacing of the primary structural joist and the primary span requirement are not maximized to minimize the amount of steel required and the amount of labor necessary for construction.

In either the conventional column and beam steel construction or the light stud and joist framing system of the prior art, the studs never extend the complete height of the building to achieve erection and assembly economy. In conventional column and beam steel construction systems, the studs are nonaxial load bearing and beams are required. Without such continuation, the studs of the light stud and joist framing system do not provide for the end reaction in the joists and each joist supports on its web the weight of all the floors above it.

Further, prior art systems do not permit a second contractor to install the wall collateral materials and additional studs to complete the construction of the building. Often in prior art systems, the horizontal bridging members between floors interfere with the studs.

Prior art designs require much hand fabrication, fitting, and welding of the component parts. These are some of the most time consuming and costly parts of fabrication and construction. Often, the steel must be cut to length, punched, and sized at the site. Often this must be done on a custom basis for each specific job. Further, where the steel lengths and sizing are not uniform, added freight and shipping costs are incurred. Most prior art steel designs of the conventional column and beam steel construction type use predominantly cold rolled strip steel which is more expensive than hot rolled strip steel.

The present invention overcomes the deficiencies of the prior art. The building framing system of the present invention may be used for both single and multi-story buildings and permits the direct attachment of standard finish collateral materials to the structural frame. The system is modular, employing a plurality of identical easily assembled frames with the steel members made of cold formed steel structural sections of light and medium gauge high strength hot rolled steel strips. The vertical column/stud members extend the full height of the structure and the horizontal joist members connect directly to the vertical column/stud members without the need for web stiffeners or welding. No H-shaped vertical columns, I-shaped horizontal beams, or open web steel joists are required. The invention permits the building to be quickly and economically enclosed so that various crafts can work simultaneously and independently of weather conditions. The quickness of the enclosure is accomplished by bolting together (although rivets, welds or screws could be used) the component parts of the system into subassemblies at ground level in a horizontal position at the job site and by using wider modules than is customarily used in light stud and joist framing systems. This reduces the work at higher elevation and the use of extensive crane time. The steel component parts are arranged such that maximum efficiency is achieved, thus reducing the total amount of steel required. The present invention emphasizes the wider modular spacing of the primary structural joist members, thus minimizing the amount of steel required. The vertical column/stud members extend the complete height of the building for erection and assembly economies and the column/stud members provide for the end reaction in the joists. Each joist supports on its web only the weight of the floor or the roof immediately above it. The wider module serves the purpose of reducing the number of frames to be erected and therefore helps increase the speed of enclosure of the building, which is one of the primary objects of the invention. Heavier column/studs are emphasized and used with a wider module to gain greater steel efficiencies. This achieves a greater efficiency of strength-to-weight ratio of both the column/studs and joists. Diagonal knee braces are used at each spacer member connection joint in lieu of horizontal bridging to reduce the length to radius of gyration ratios about the minor axis, and simultaneously provide rigidity of the frame. The system allows the insertion of intermediate non-load bearing studs, which are compatible dimensionally with the column/studs, at a later time to carry collateral materials without interference of any horizontal bridging members. Thus, the additional studs and wall collateral materials may be added by another contractor. The system is designed so as to maximize the use of the metal form of floor decking for concrete and of ceiling systems. Another object of the invention is to reduce to an absolute minimum the hand fabrication, fitting, and welding required for construction. The system emphasizes bolted assembly rather than welding or riveting or screwing at the job site. The frames can be fabricated into the finished part by a punching and forming operation, which can be accomplished by an automated production line in which the strip steel is decoiled, cut to length, punched, and formed in a continuous automated sequence with a minimum of hand labor, and yet still permit individual parts to be fabricated on a custom basis for each specific job. Because the steel structure is not partially preassembled at the plant, it is possible to efficiently load trucks, thereby reducing freight and shipping costs.

Structural sections formed from sheet metal have very precise and restrictive limitations imposed by buckling of the metal if the width-to-thickness ratio is too large. The height-to-thickness ratios of the depths of the joists is 150 times the thickness. Thus, a 16 gauge joist 0.060 can be only 9" deep but a 9" deep joist is not efficient beyond a span of 18 feet. Spans of 18 feet are not convenient spans for most construction because the room areas are too small. Therefore, it is desirable to have deeper joists which in turn requires thicker metal. To be economical, the thicker metal joist must be spaced on wider modules than is customary in light stud and joist framing systems (usually 16-inch or 24-inch on center).

The framing system of the present invention eliminates the need for headers required in most other systems. The assembled framing system does not require the studs, located between column/studs for example, to be load-bearing studs, and thus no headers are necessary between the column/studs to support any vertical load between adjacent joists. Since most doors, windows and stairs can be accomodated in a four foot spacing for studs and joists, the need for expensive headers to support the floors and roof loads is therefore largely eliminated.

Ceilings are usually suspended from joists to accomodate mechanical ducts, plumbing, and electrical equipment, and most ceiling suspension systems span four feet quite economically, although again a six or even eight foot span is not a great deal more expensive. The cost of a suspended ceiling to span 4 feet is the same as one to span 2 feet since they are very light and are designed for a 4 foot span initially. A 6 foot span requires only a few more wires than a 4 foot span and even an 8 foot span does not greatly add to the costs because most suspended ceilings are so light in weight.

Other objects and advantages of the invention will appear from the following description.

BRIEF DESCRIPTION OF THE DRAWINGS

For a detailed description of a preferred embodiment of the invention, reference will now be made to the accompanying drawings wherein:

FIG. 5 is an enlarged detail elevation view of a part of the view shown in FIG. 2;

FIG. 6 is a section view at plane 6—6 of the stud shown in FIG. 5;

FIG. 7 a section view at plane 7—7 of the joist shown in FIG. 5;

FIG. 8 is an enlarged section view at the plane 8—8 shown in FIG. 2;

FIG. 9 is an elevation view of the view in FIG. 8;

FIG. 10 is enlarged portion of the plan view of FIG. 4;

FIG. 11 a section view at plane 11—11 of the bridging member in FIG. 10;

FIG. 12 is a side view of the view in FIG. 10;

FIG. 13 is a section view at plane 13—13 shown in FIG. 2;

DESCRIPTION OF THE PREFERRED EMBODIMENT

Figure 1:
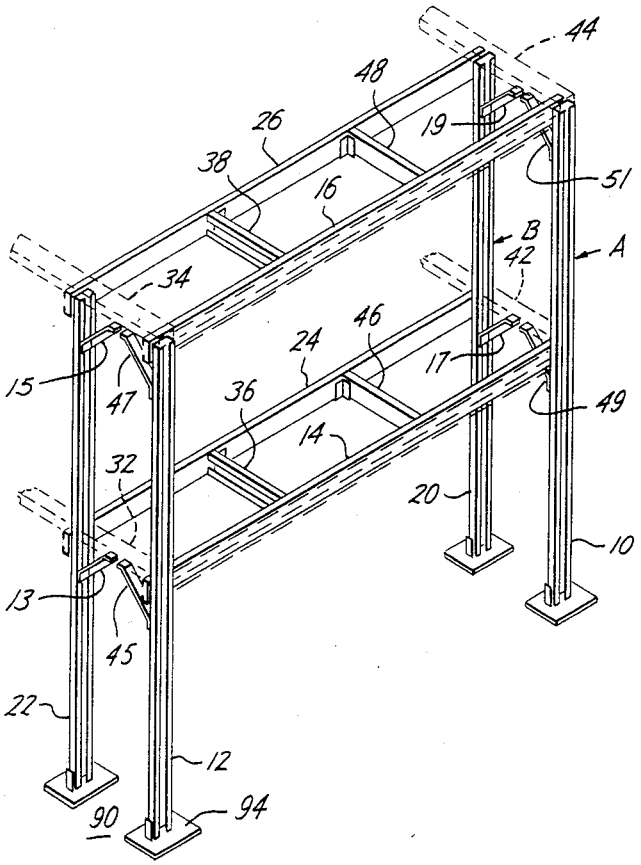
FIG. 1 is a pictorial view of a building framing system according to invention.
Figure 2:
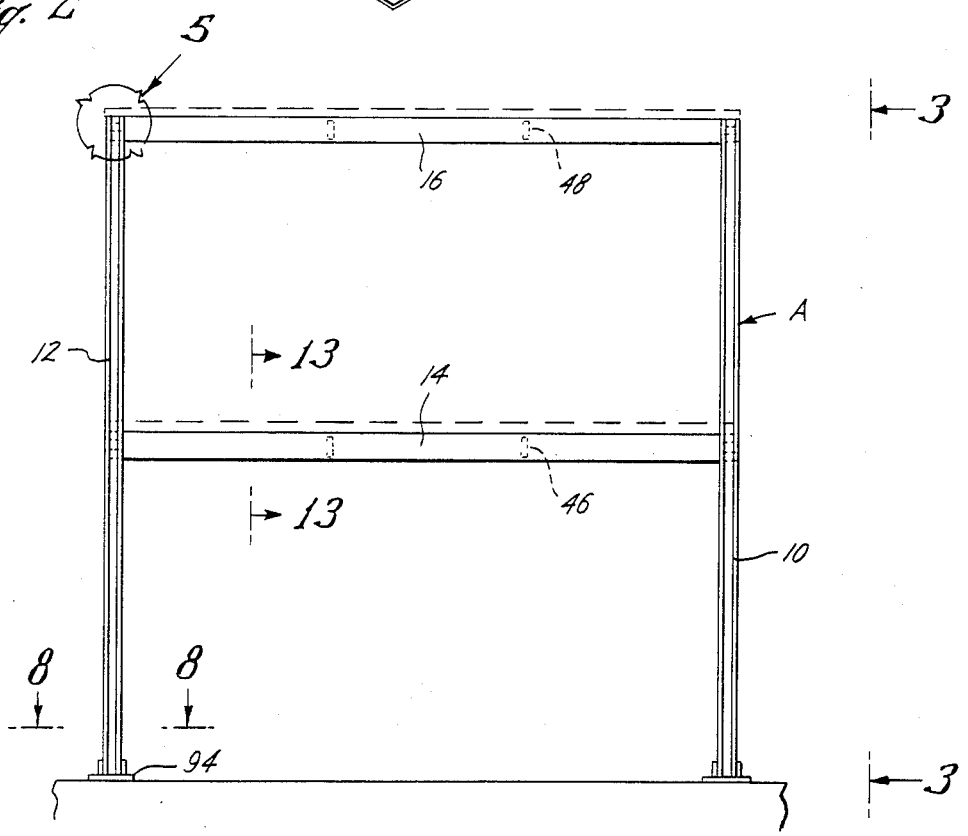
FIG. 2 is an elevation view of a framing unit.

The building framing system of the present invention includes a plurality of frame units designated A, B, C, etc. shown in FIGS. 1–4. Referring initially to FIGS. 1 and 2, there is shown a two-story frame unit A. Since the frame units are the same, a description of unit A will be illustrative of the description of the other units B, C, D, etc. Frame unit A consists of two elongated vertical, load-bearing column/studs 10, 12 connected by two horizontal ceiling and floor joists 14, 16 extending horizontally between column/studs 10, 12. As used herein with reference to the invention, the term "column/-stud" is a unique and hybrid structural member since it combines the features of a column and a stud. It is a column because it is a slender upright member which supports superincumbent weight and it is a stud because it is an upright member to which wall surface collateral material is directly attached. Adjacent joists 14, 16 are vertically spaced apart a distance sufficient for one floor of the building which may run from two floors up to approximately twelve floors. The number of column/-studs and joists will vary with the width and number of floors of the building, respectively. The joists will typically have a span of between 15 and 30 feet, although not limited to these spans.

Frame unit B, shown in FIG. 1 adjacent unit A, similarly has vertical column/studs 20, 22 with connecting horizontal joists 24, 26.

As shown in FIGS. 1–4, frame units A, B, C, etc. are erected in parallel and are spaced apart a suitable distance, as, for example, four, six, or eight feet, although not limited to these spaces. The frame units are connected together by means of spacer members being provided at each end of each floor. As shown in FIG. 1, frame units A and B are connected together on one side by spacer members 32, 34 and on the other side by spacer members 42, 44. Diagonal knee braces 45, 47 and 49, 51 extend diagonally between spacer members 32, 34 and column/stud 12 on one side and spacer members 42, 44 and column/stud 10 on the other side, respectively. Further diagonal knee braces 13, 15 and 17, 19 extend diagonally between spacer members 32, 34 and column/stud 22 on one side and spacer members 42, 44 and column/stud 20 on the other side, respectively. The diagonal knees are connected to the spacer members approximately two feet from the adjacent column/stud. The diagonal knee braces reduce the length to radius of gyration ratios about the minor axis of column/studs 10, 12 and 20, 22, and simultaneously provide rigidity to the modules.

As seen most clearly in FIGS. 5–7, each of the column/studs, such as column/stud 12, has a generally C-shaped cross-section. Column/stud 12 is formed of strip metal of unitary construction and includes a web 52, flanges 54, 56 which extend normal from opposite edges of web 52, and flange stiffeners 58, 60 which extend from the distal edges of flanges 54, 56 in parallel with web 52. Flange stiffeners 58, 60 define an opening 62 there between to afford access to the interior of column/stud 12.

A joist, such as joist 16, also has a generally C-shaped cross-section as shown in FIG. 7 including a web 72, flanges 74, 76 and flange stiffeners 78, 80 creating an opening 82 therebetween.

As should be apparent from FIGS. 1–7, the frame units A, B, C, etc. of the present invention only use column/studs and joists and do not use vertical columns made up of steel beams with an I or H shape or pipe; nor does the present invention use horizontal I-shaped steel beams or horizontal open web joists. In the present invention, the load bearing column/studs, such as 10, 12, have dimensions compatible with the non-load bearing studs, such as 170 shown in FIG. 16, although the gauge of steel will differ. In conventional column and beam steel construction, the columns and beams are widely spaced and support heavier loads, and the studs are closely spaced and support no axial loads. In the present invention, the columns and beams of the conventional column and beam steel construction are eliminated. In light stud and joist framing systems, only studs and joists are used but door and window headers and joist web stiffeners are required. Door and window horizontal headers and joist web stiffeners are mostly eliminated in the present invention.

The studs and joists of frame units A, B, C, etc., composed of these rectangle steel C-shapes (often termed "Cee" shapes in the trade), are cold-formed from light and medium gauge high strength steel strips in coils. Steel beams are normally produced in stock lengths of 40, 50, and 60 foot lengths and a scrap loss will result when a length less than these is required. Although there may be some loss at the ends of the coil, these can be used for the most part in producing the spacer members or bracing for the system.

The steel for the frame units is from, to the maximum amount possible, hot rolled sheets in coils (16 gauge and heavier) which is one of the least expensive forms of steel. This is accomplished by utilizing as wide a modular spacing as possible between the frame units to efficiently use heavier gauged steel where possible. Thus, the system uses the hot rolled strip rather than the cold rolled strip and reduces steel unit (lb.) costs.

Since the vertical members of the present invention are C-shaped steel formed from medium gauge (16 gauge, 0.0598" thick, through 3 gauge, 0.2391" thick, high strength) 50,000 psi structural steel strip, these C-shapes are compatible dimensionally with light gauge steel shapes which can be added later as, for example, non-load bearing studs 170.

As shown in FIG. 5, joist 16 is fastened to column/-stud 12 at its upper end by juxtaposing webs 52, 72 back-to-back. A similar connection secures the other end of joist 16 to column/stud 10 and the ends of joist 14 to column/studs 10, 12. Joists 14, 16 are secured to column/studs 10, 12 as seen in FIG. 2, so as to be spaced vertically approximately 10 feet apart to allow a floor therebetween. In a typical embodiment, column/studs 10, 12 have a length of approximately 10 feet for each floor of the building and may vary between 8 and 12 feet. Column/stud 12 has four bolt holes corresponding to the four bolt holes in joist 16. Upon installation, these bolt holes register for receiving anchor bolts 84 shown in FIG. 5. Thus, as shown in FIG. 1, column/studs 10, I2 extend the full height of the structure, the horizontal joists 14, 16 connect directly to column/studs 10, 12 by bolting the two members together web to web, and frame units A, B are connected by spacer members 32, 34 and 42, 44. Since column/studs 10, 12 extend past joists 14, 16, column/studs 10, 12 stiffen the webs of the joists. The fact that the column/studs are continuous through two or more floors effects a substantial reduction in the Section Modulus about the major axis for wind loading at the exterior walls. This is known as continuity of design through multiple spans.

Each joist and spacer member supports only the floor or roof immediately above it. This arrangement eliminates the need for additional web stiffeners at the end of the joists since the column/stud serves as a stiffener. The plumbing and alignment of the complete frame is much faster than in frame systems that stop each floor.

The present invention permits the custom design and fabrication of the size and thickness of steel for each specific job and sizes the steel component parts so as to achieve maximum efficiency and reduce the total amount of the steel to a minimum.

The horizontal joists account for approximately three times the weight in pounds per square foot of floor area as compared to the vertical column/studs. Thus, there is a substantial savings in using heavier gauge joists at a wider spacing. It is generally true that the greater the primary span requirements of a structure, the wider the spacing of the primary horizontal structural members. This is because the span is principally a function of the depth of the horizontal structural member and the depth in turn is limited by the thickness of the web. The web depth is limited to a ratio of 150 times the thickness of the web. The web is defined as the portion of the structural member which is perpendicular to the plane of the span direction. These functions are true of any type material. Thus, as the span requirements increase, a wider modular spacing of the primary structural joist member is desirable. This in turn requires deeper joists than for lesser spans. Since the depth is a ratio of the thickness, a greater thickness is required, which in turn produces a heavier joist. Economy dictates a wider spacing.

This invention proposes the use of wider modular spacing of the joists such as 4 feet, 6 feet, or even 8 feet, but it is not intended that the invention should be limited to those modules. A wider modular spacing of 4, 6, or 8 feet results in a more efficient width to thickness ratio in more situations than is possible with a modular spacing of 16 inches or two feet. This is possible primarily because the depth of the joists can be increased if the steel is thicker.

The wider spacing of the joists also eliminates the extra job site labor of installing the closer spaced joist members, and also the extra job site labor of attaching a deck to the closer spaced members. The wider spacing of the structural members without the horizontal bridging also allows most any doors or window openings to be framed without the interference of any horizontal bridgings. The wider spacing also mostly eliminates the need for headers and allows the column/studs to transfer the loads directly to the foundation. A wider module also serves the purpose of reducing the number of frames to be erected and therefore helps to increase the speed of enclosure of the building.

In the prior art the customary spacing of studs and joists for light stud and joist framing systems is 24" on center or less, which is dictated by the span of the collateral materials used which is usually a $\frac{5}{8}$" gypsum board. Sometimes a thinner gypsum board of $\frac{1}{2}$" is used which further reduces the spacing to 16" on center. Thus, the spacing of wall studs is dictated by the common collateral materials used in conjunction with the framing system. Since the spacing requirement for standard collateral materials is different for studs and joists, and since joists account for approximately three times the weight on a square foot basis as studs, it is desirable to give preference to the joist spacing requirements and simply use lighter non-loading bearing studs between the structural column/studs to accommodate the closer spacing required for the wall collateral material.

The wider spacing of the column/studs and joists makes a more efficient use of steel than a closer spacing because of the width and height thickness ratios. A 12" by $3\frac{1}{2}$" flange by 12 gauge Cee joist has an Ix of 43.8 in.$^4$ with a weight of 7.31 pounds per lineal foot. An 8" by 3" flange by 16 gauge Cee joist has an Ix of 8.79 in$^4$ with a weight of 3.08 pounds per lineal foot. Thus, the deeper section is slightly over twice as efficient in structural value per pound of steel.

The maximum width to thickness ratios at which stiffened compression elements are fully effective is 23.2 times the thickness for steel with a stress $f_b$, psi of 30,000 pounds. Thus, a 9" by $3\frac{1}{4}$" flange by 12 gauge Cee joist has an $S_x$ of 4.66 in$^3$ with a weight of 5.95 pounds per foot of steel which is an $S_x$ of 0.7832 per pound of steel. Whereas a 9" by $3\frac{1}{4}$" flange by 16 gauge Cee joist has an $S_x$ of 2.36 in$^3$ with a weight of 3.40 pounds per foot of steel which is an $S_x$ of 0.6941 per pound of steel. Thus, the heavier 12 gauge joist is 13% more efficient per pound of steel than the lighter 16 gauge joist, but to utilize its strength it must be spaced on a relatively wider module than the lighter 16 gauge joists. Hence, a wider module is used in the present invention.

Referring to FIGS. 8 and 9, the foundation typically comprises a concrete slab 90 which has a counter sunk surface 91 from which protrudes a plurality of anchor members 92. Anchor members 92 have base portions (not shown) that are embedded in and retained in surface 91 of the concrete slab 90. In laying out the forms for the foundation and anchor members 92, the position of the anchor members 92 is established according to the position of the desired frame units and the spacing between adjacent units. For example, the frame units typically are spaced 4 feet apart and in typical application of the invention, anchor members 92 are spaced precisely on 4 foot centers. The portion of anchor member 92 that protrudes above surface 91 of slab 90 is adapted to receive anchor plate 94 and is bolted thereto. Channel base 96 is welded to anchor plate 94 and dimensioned to telescopingly receive the lower end of column/stud 12. Channel base 96 has 4 holes which register with 2 holes through web 52 and one each through flanges 54, 56 in the end of column/stud 12. These holes receive bolts 98. During erection, the lower extremity of column/stud 12 is telescoped into channel base 96 of anchor plate 94 and is bolted thereto. Opening 100 affords access to bolts 98 after column/stud 12 has been plumbed. Although channel base 96 is shown mounted vertically on surface 91 of foundation 90, channel base 96 may be mounted to foundation 90 in the horizontal position, and may be a continuous channel on top of and extending the length of foundation 90 to receive all column/studs on that side.

Upon assembling frame unit A, joists 14, 16 are bolted to column/studs 10, 12 as shown in FIG. 1. Diagonal knee braces 45, 47 and 49, 51 are connected to column/studs 12, 10 respectively and to spacer members 32, 34 and 42, 44 which are bolted also to column/studs 10, 12, all at ground level. Frame unit A is then raised to the vertical position by a crane and temporarily held upright until unit B is then raised by the crane. Units A, B are then connected together by spacer members 32, 34 on one side and spacer members 42, 44 on the other side and by diagonal knee braces 13, 15 on one side and braces 17, 19 on the other side. Referring now to FIGS. 10–12, there is shown a detail of a typical connection of units A, B by a spacer member such as member 34. As shown in FIG. 11, spacer member 34 includes a web 110, flanges 112, 114 which extend normal from opposite edges of web 110, and flange stiffeners 116, 118 which extend from the distal edges of flanges 112, 114 in parallel with web 110. Flange 114 is shorter than flange 112. Flange stiffeners 116, 118 define an opening 120 therebetween to afford access to the interior of bridging member 34.

With respect to the connection between unit A and member 34 shown in FIG. 10, the web 110 of member 34 contacts flange 74 of joist 16. Bolts 122, passing through aligned holes in web 110 and flange 74, connect spacer member 34 to joist 16.

With respect to the connection between frame unit B and spacer member 34, a support bracket 130 is received and disposed within column/stud 22. Bracket 130 supports spacer member 34. Bracket 130 and web 110 have registering holes for receiving bolts 138 to attach member 34 to bracket 130 and thus to column/stud 22. Diagonal knee braces 47 supports spacer member 34 during erection.

Figure 14:
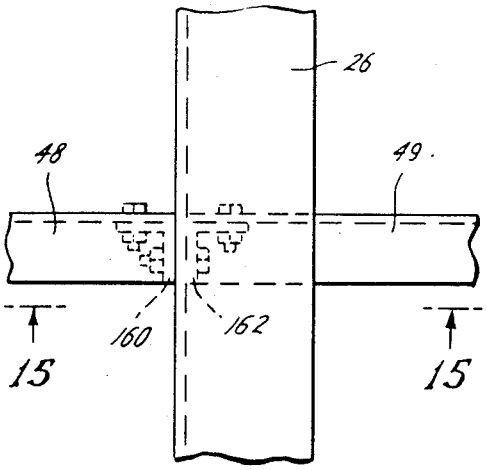
FIG. 14 is an enlarged view of a portion of FIG. 4.
Figure 15:
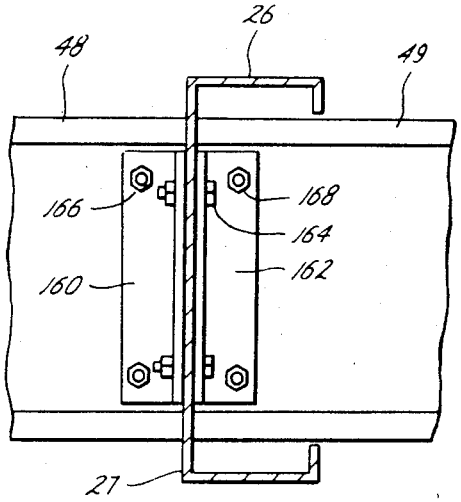
FIG. 15 is a side view of the connection shown in FIG. 14.

Referring now to FIGS. 14 and 15, there is shown a typical connection by an interior bridging member. Interior bridging members 48, 49 are secured to joist 26 by angle iron supports 160, 162. Supports 160, 162 have one of their flanges engaging the web 72 of joist 26 and are bolted thereto by bolts 164. The opposite flanges of supports 160, 162 are bolted to the ends of members 48, 49 at 166, 168 respectively for connecting members 48, 49 to joist 26. It can be appreciated that supports 160, 162 may be formed by simply bending the end of the bridging member perpendicular to the direction of the joist.

Figure 3:
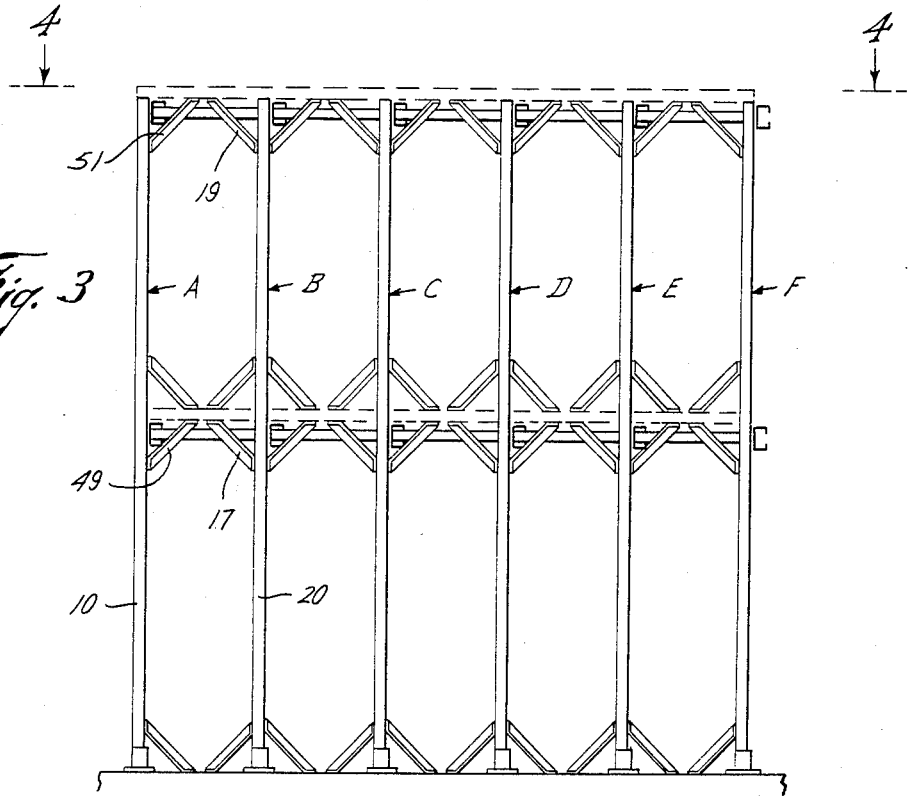
FIG. 3 is a side view of the framing unit of FIG. 2 affixed to other units.
Figure 4:
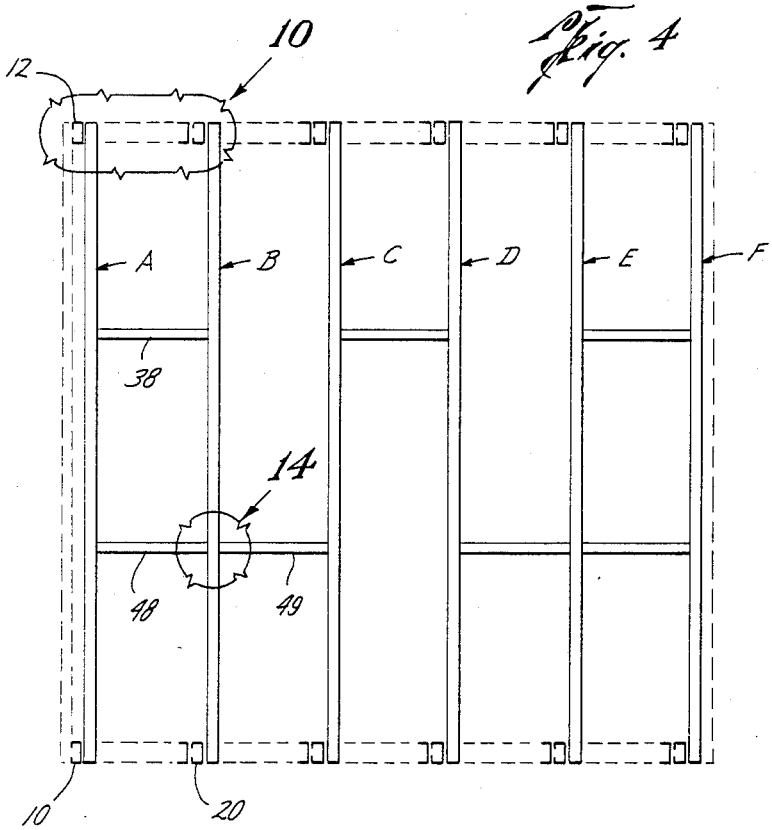
FIG. 4 is a plan view of the framing unit of FIG. 2 affixed to framing units of FIG. 3.

Referring again to FIG. 1, diagonal knee braces 45, 47 and 49, 51 are provided diagonally between spacer members 32, 34 and column/stud 12 on one side and between spacer members 42, 44 and column/stud 10 on the other side, respectively, to reduce the length/radius of gyration ratio about the minor axis of column/studs 10, 12 and simultaneously provide rigidity. Since the diagonal knee braces are all substantially the same in design and operation, a description of one will be a typical description of the others. Diagonal knee brace 51 is angled or L-shaped, although it may be of any other cross-section well known in the art. Each end of brace 51 has its vertical side cut and notched and its more horizontal side bent for engagement with column/stud 10 and spacer member 44. One end of brace 51 is bolted to web 52 of column/stud 10 about $1\frac{1}{2}$ to 2 feet below the connection between column/stud 10 and spacer number 44. The other end of knee brace 51 is bolted to web 110 of spacer number 44 about $1\frac{1}{2}$ to 2 feet from the connection of column/stud 10 and spacer member 44. By using diagonal bracing rather than horizontal bracing, there is no interference in later installing non-load bearing studs. By bracing the column/studs about their minor axis, the ratio of the length-to-radius of gyration of the column/studs is reduced about the minor axis thereby adding effective strength to the column/studs in the frame units. Further, as shown in FIG. 3, additional diagonal knee braces may be added from the floor to the column/studs reducing further the length-to-radius of gyration about the minor axis.

The ratio of width to thickness of the column/studs is very important since their principal loading is axial causing them to be primarily in compression. There is a definite limitation of width/thickness ratios called a "Q" value. This simply reduces the allowable stress permitted to compensate for the width/thickness ratios which are excessive. This can result in as much as a one-third reduction. The axial loading of the column/studs is greatly affected by the "Q" factor which is the ratio of the effective steel to the total steel of their cross-sectional area. Where this ratio is less than 50%, more than 50% of the steel is ineffective.

A popular stud size is $3\frac{1}{2}''$. A $3\frac{1}{2}''$ by 2" by 18 gauge stud has a "Q" factor of 0.779, an $r_x$ of 1.43, an area of 0.389 square inches, and weight per foot of 1.36. The "Q" factor of 0.779 times the area of 0.389 times the $r_x$ of 1.43 produces a structural value of 0.43 for 1.36 pounds per lineal foot. A $3\frac{1}{2}''$ by 2" by 12 gauge has a "Q" factor of 0.991, an $r_x$ of 1.38, an area of 0.847, and a weight per foot of 2.95 pounds per lineal foot. The "Q" factor of 0.991 times the area of 0.847 times the $r_x$ of 1.38 produces a structural value of 1.16 for 2.95 pounds per lineal foot. Thus, the heavier 12 gauge stud is approximately 25% more efficient in structural value per pound of steel than the lighter 18 gauge stud. To utilize this efficiently, the structural frame requires a wider modular spacing.

One example of a module of the present invention includes a 15 foot span between column/studs, a 6 foot spacing between frame units and a 10 foot height between floors. In a typical frame unit, such as unit A, the vertical column/studs 10, 12 have a $3\frac{1}{2}''$ web dimension, a 2" flange and a 14 gauge thickness. The non-load bearing studs 170 have dimensions compatible to those of column/studs 10, 12, but are 20 gauge. The horizontal joists 14, 16 have a web dimension of 9", a flange width of 3" and a 12 gauge thickness. The spacer members 32, 34, 42, 44 may be C-shaped, L-shaped , round rods or tubes. The braces are also angles with dimensions of $1\frac{3}{4}'' \times 1\frac{3}{4}'' \times 14$ gauge but may be other gauges and dimensions. These braces may also be channel or C-shaped, round rods or tubes.

Figure 16:
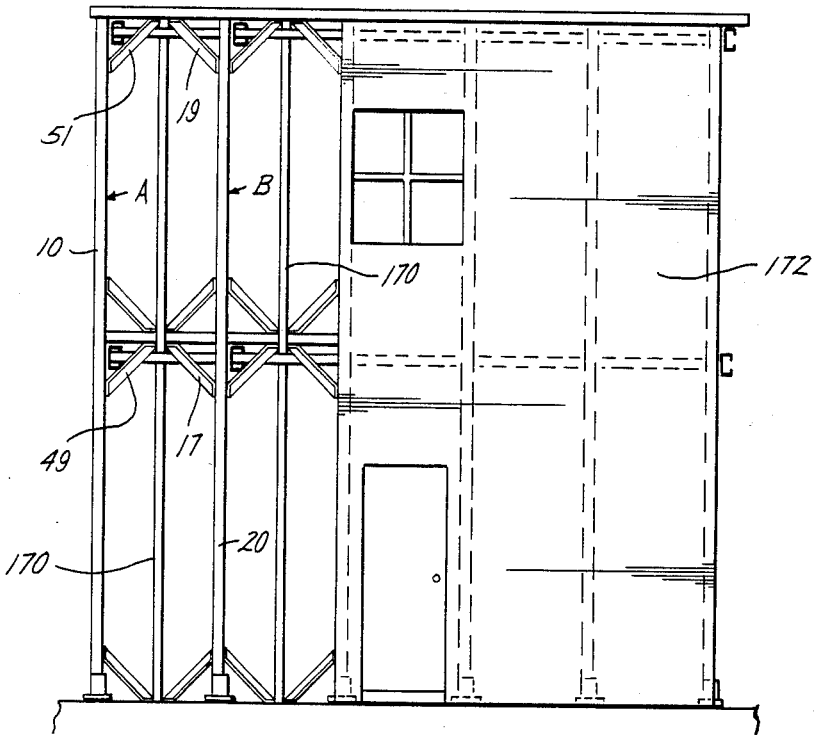
FIG. 16 is an elevation view of the framing system shown in FIG. 3 with collateral materials partially installed.

Referring now to FIG. 16, there is shown a frame unit having non-load bearing studs 170 with collateral wall material 172 installed thereon.

Studs 170 are standard lightweight 20 or 25 gauge and are inserted vertically between the joists for the mounting of the wall collateral materials which is usually $\frac{5}{8}''$ gypsum board with a span capability of 2 feet. Another contractor can insert additional studs in the frame since a working platform has been provided by the metal decking hereinafter described with respect to FIG. 13, and because no horizontal bridging is installed between the floors to interfere with these studs.

The non-load bearing studs 170 extend only from one floor to the next. The combined weight of these studs plus the medium gauge structural studs will usually be less than the combined weight of the light gauge structural studs at closer spacing than the heavier medium gauge. A $3\frac{1}{2}''$ by 25 gauge lightweight stud 170 weighs only about 0.47 pounds per linear foot and a 6" by 25 gauge lightweight stud weighs about 0.64 pounds per lineal foot. These are both standard. Therefore, several can be installed between the load bearing column/studs at wider spacings before there is a weight combination of studs which exceeds the weight at a lesser spacing with a lighter standard stud.

To effect this arrangement of utilization of light non-load bearing studs 170 between the load bearing structural column/studs, it is desirable to eliminate horizontal bridging between column/studs so that the primary structural members (the column/studs and the joists) can be erected as a single unit and the non-load bearing studs can be added later. Thus, a space module of 4, 6, or even 8 feet can be used for both the load bearing column/studs and joists, and the column/studs can be dimensionally compatible with non-load bearing studs so that these non-load bearing studs can be later added to accommodate the gypsum wall board or other material.

Since the load bearing column/studs have a dimension which is compatible with the lighter non-load bearing studs, the lighter non-load bearing studs can be placed between the load bearing column/studs to provide a closer stud spacing for the purposes of attaching the collateral material.

One's choice of collateral finish materials is virtually unlimited since these collateral materials can be quickly and easily attached to the steel frame with self-drilling, self-tapping screws. This is a relatively new construction technique but is now widely used throughout the United States. The rectangular shape of the Cee structural member allows attachment of collateral materials on all sides.

Various types of roofs may be affixed to the system. For example, as shown in FIG. 1, a common concrete roofing or flooring may be supported by spacer members 32, 34, 42, 44 and horizontal joists 16, 26, 14, 24. One such roof 140, shown in FIG. 5, consists of a screed channel sheet metal 142. Connectors may be used to attach screed channel 142 to joists 16, 26 and spacer members 34, 44. Screed channel such as 142 may also be used for floor 150 such as is shown in FIG. 13.

The cost of a steel concrete-form decking to span 4 feet is approximately the same cost as the cost of a decking to span 2 feet. A 26 gauge by 1.3" deep corrugated steel decking will span four feet and weigh 1.06 pounds per square foot. A 28 gauge by 0.6" deep corrugated decking to span 2' weighs 0.83 pounds per square foot, but 28 gauge steel costs slightly more per pound than 26 gauge so there is very little difference in the cost per square foot. The weight per square foot of steel concrete-form decking to span 6 feet is 1.8 pounds per square foot, and the weight per square foot of steel concrete-form decking to span 8 feet is 2.01 pounds per square foot. A steel roof decking to span 8 feet weighs only 1.3 pounds per square foot.

The present invention permits a composite design for economy and extra floor rigidity where the spans and loading warrant. This is accomplished by bolts which extend into the concrete floor and which are attached to the top of the joist flange with a nut on each side of the flange. When the composite design is used, the joists are precambered for accommodation of the dead load of the concrete or shored temporarily until the concrete is set.

The floor decking provides a bridging between the joists of the adjacent frame units and may, with the assistance of the diagonal bracing, reduce the need for interior bridging members.

Since the predominant collateral wall material used in construction is gypsum board, it is desirable to provide supporting framing at 24" or less on the collateral wall material. Metal decking, however, for floors and roof can easily and economically span 4 feet. Metal decking with a six foot or even eight foot span is not a great deal more expensive than four foot decking.

The framing system eliminates the need for headers required in the light stud and joist framing system of the prior art. In FIG. 16, the assembled framing system does not require studs 170, located between column/studs 10, 20 for example, to be axial load bearing studs, and thus no headers are necessary between column/studs 10, 20 to support any vertical load between adjacent joists such as 14, 24. Since most doors, windows and stairs can be accommodated in a four foot spacing for studs and joists, the need for expensive headers to support the floors and roof loads is therefore eliminated.

Ceilings are usually suspended from joists to accommodate mechanical ducts, plumbing, and electrical equipment, and most ceiling suspension systems span four feet quite economically, although again a six or even eight foot span is not a great deal more expensive. The cost of a suspended ceiling to span 4 feet is the same as one to span 2 feet since they are very light and are designed for a 4 foot span initially. A 6 foot span requires only a few more wires than a 4 foot span and even an 8 foot span does not greatly add to the costs because most suspended ceilings are so light in weight.

The preferable procedure for construction is to cut the elements to length and punch the bolt holes at the shop, and then transport the unassembled elements to the job site. The framing units are then assembled and bolted together on the ground before erecting into position, being temporarily held into position by suitable bracing and stiffening members.

Non-load bearing studs, as needed for wall coverings, etc., may be erected between units A, B and fastened to the spacer members to form a wall between the units. No additional joists are needed because normal floor structural material is adequately supported on joists spaced 4 feet apart.

The materials are placed in their final position as an assembly instead of piece-by-piece. This is possible because the column/studs extend the full height of the building and are connected not only to the joists at ground level but also to the horizontal spacer members and to diagonal knee braces between the horizontal spacer members and the column/studs at ground level. The diagonal knee braces between the column/studs and horizontal spacer members serve to brace the column/stud about the minor axis during the assembly, during the erection, and for the final construction load.

It is possible to erect the frame subassemblies singly or together in pairs which further reduces crane time. It is also possible to extend the joists past the supporting column/studs to another bay if the spans are not too great, and if common column/studs are used at each bay intersection. This joist extension can also provide balconies or roof overhangs.

All component parts are bolted together and no welding is involved; however, welding is not excluded. The C-shaped structural members and/or angle supports can be punched in cold form from flat strip with a minimum of labor even if they are custom fabricated for each job.

The present design reduces to an absolute minimum hand fabrication and welding of the component parts. The fitting and welding of steel is one of the most time-consuming and costly parts of fabrication. Since the job site assembly is by bolting, and virtually no welding is required, the connections can be made very quickly. Since the structural members are C-shaped and are bolted together back-to-back, they can be fabricated into the finished part by a punching and forming operation with virtually no welding. This can be accomplished by an automated production line in which the steel strip is decoiled, cut to length, punched, and formed in a continuous automated sequence with a minimum of hand labor. Even though the production line is automated, the individual parts can still be fabricated (punched) on a custom basis for each specific job. The present invention offers custom design, fabrication, and erection on a specific job basis, but utilizing mass production techniques.

The present building frame system permits a quick enclosure. This is accomplished by bolting together component parts of the system into subassemblies at ground level and at a horizontal position permitting much of the work to be performed at ground level rather than at a higher elevation. Thus, the work can be done faster, more efficiently, and can be accomplished with less skilled labor. Further, the building can be enclosed quickly and economically. This allows all the various crafts to work simultaneously and independently of weather conditions, thus permitting the crafts to work on the job at a very early time in the construction schedule and to complete work faster than in prior art systems.

Steellumber, the trademark for the system described below, is a new concept in construction which has reduced construction time and costs. Steellumber offers the best of both steel and lumber in that it is competitive in cost with wood, has the design flexibility of wood, offers the construction speed of steel construction, has the quality of steel, has the fire resistance of steel, and is termite-proof. The cost of steellumber is competitive in cost with wood because of savings in job site labor and because the component parts can be custom fabricated for quick assembly due to the use of bolted connections. Further, the components can be assembled in a multi-story frame for erection in a single unit. The initial cost of a steellumber frame is less than a conventional column and beam steel construction and considerably less than a masonry or concrete frame. It is also competitive in initial cost with a wood frame and will reduce insurance coverage over a wood frame structure. The steellumber building frame system of the present invention is well suited for multi-story construction for motels, condominia, apartments, hospitals, nursing homes, office buildings, schools, and dormitories.

While the preferred embodiment of the invention has been shown and described, modifications thereof can be made by one skilled in the art without departing from the spirit of the invention.

What is claimed is:

1. A structural framework for a multi-story building having a foundation comprising:

first and second multi-story framing units, each said framing unit having'at least two unitary vertical load bearing column/studs and at least one horizontal joist, each of said unitary column/studs extending from the foundation to the top of the multi-story building and being a C-shaped steel member;

a first bolted connection connecting the ends of said horizontal joist to said column/studs;

a plurality of horizontal spacer members extending between said first and second framing units, a second bolted connection connecting one end of said spacer members to said first framing unit and a third bolted connection connecting the other end of said spacer members to said second framing unit, said third bolted connection including a support bracket having an angle-like body with a horizontal projecting flange, said angle-like body being received within said column/stud and bolted thereto, said horizontal projecting flange being bolted to a web of said spacer member;

means for anchoring the lowermost ends of said column/studs to the foundation;

said horizontal joists and spacer members forming supports for floors and a roof;

a plurality of nonaxial load bearing studs extending vertically between said spacer members, said nonaxial load bearing studs being arranged for support of wall collateral materials; and interior bridging members extending between adjacent framing units and interior of said spacer members, said interior bridging members being connected to said joists by a fourth bolted connection including angle iron supports having one flange bolted to said joists and the other flange bolted to said web of said interior bridging members.

2. A structural framework for a multi-story building having a foundation comprising:

first and second multi-story framing units, each said framing unit having at least two unitary vertical load bearing column/studs and at least one horizontal joist, each of said unitary column/studs extending from the foundation to the top of the multi-story building and being a C-shaped steel member;

a first bolted connection connecting the ends of said horizontal joist to said column/studs, said first bolted connection including juxtaposed exteriors of transverse webs of said column/stud and said joists;

a plurality of horizontal spacer members extending between said first and second framing units, a second bolted connection connecting one end of said spacer members to said first framing unit and a third bolted connection connecting the other end of said spacer members to said second framing unit, said second bolted connection including engagement of a web of said spacer members against a flange of said joists and connecting said spacer members to a web of said column/studs, said third bolted connection including a support bracket having an angle-like body with a horizontal projecting flange, said angle-like body being received within said column/stud and bolted thereto, said horizontal projecting flange being bolted to said web of said spacer members;

means for anchoring the lowermost ends of said column/studs to the foundation;

said horizontal joists and spacer members forming supports for floors and a roof; and a plurality of nonaxial load bearing studs extending vertically between said spacer members, said nonaxial load bearing studs being arranged for support of wall collateral materials.

3. A structural framework for a multi-story building having a foundation comprising:

first and second multi-story framing units, each said framing unit having at least two unitary vertical load bearing column/studs and at least one horizontal joist, each of said unitary column/studs extending from the foundation to the top of the multi-story building and being a C-shaped steel member;

a first bolted connection connecting the ends of said horizontal joist to said column/studs;

a plurality of horizontal spacer members extending between said first and second framing units, a second bolted connection connecting one end of said spacer members to said first framing unit and a third bolted connection connecting the other end of said spacer members to said second framing unit, said third bolted connection including a support bracket having an angle-like body with a horizontal projecting flange, said angle-like body being received within said column/stud and bolted thereto, said horizontal projecting flange being bolted to a web of said spacer member;

means for anchoring the lowermost ends of said column/studs to the foundation;

said horizontal joists and spacer members forming supports for floors and a roof; and a plurality of nonaxial load bearing studs extending vertically between said spacer members, said nonaxial load bearing studs being arranged for support of wall collateral materials.

4. The framework as defined by claim 1, 2, or 3 wherein said column/studs, joists, and spacer members are positioned on said framing units to permit the use of nonaxial load bearing studs therebetween.

5. The framework as described by claim 1, 2, or 3 wherein said column/studs are made of 16 to 3 gauge steel and said non-load bearing studs are made of 26 to 16 gauge steel.

6. The framework as defined by claim 1, 2, or 3 wherein said column/studs extend the full height of the multi-story building, said column/studs providing for the end reaction of said joists and each said joists supporting on its web only the weight of a floor or roof immediately above it.

7. A prefabricated building constructed on a foundation comprising:

a plurality of frame units mounted on the foundation with adjacent frame units being connected together by spacer members;

each of said frame units including at least two unitary vertical column/studs extending the full height of the building and a horizontal joist extending between said column/studs for each floor and roof, the ends of each of said joists being connected to said unitary column/studs;

said column/studs, horizontal joists, and spacer members being made of steel members having a channel-like cross section, said steel members having a web, two flanges extending normal from the opposite edges of said transverse web, and two flange stiffeners extending from the distal edges of said flanges;

a first connection between said column/studs and horizontal joist including engagement of said web of said horizontal joist against said web of said column/studs and bolting said joist to said column/studs;

a second connection between one end of said spacer members and said column/studs including engagement of said flange of said spacer member against a web of said column/studs and bolting said spacer member to said column/stud;

a third connection between the other ends of said spacer members and said column/studs including a support bracket having a channel-like body with a horizontal projecting flange, said channel-like body being received within said column/stud and bolted thereto and said horizontal projecting flange being bolted to said web of said spacer member;

a base for each of said column/studs anchored into the foundation and a channel affixed to said base for receiving the lower end of said column/stud, said column/stud being bolted to said channel;

interior bridging members being secured to adjacent column/studs and made of steel members having a channel-like cross section with a web;

a fourth connection between said joists and interior bridging members including supports bolted to said joists to said web of said interior bridging members;

diagonal braces extending from said column/studs to said spacer members;

a roof attached to the uppermost of said joists and spacer members;

a decking for each floor and attached to the planar joists of each floor;

non-load bearing studs in between said joists and column/studs; and wall collateral materials installed on said non-load bearing studs, spacer members, and column/studs.

8. A method for erecting a multi-storied building on a foundation comprising the steps of:

assembling a first frame unit in a substantially horizontal position by bolting a plurality of joists, one for each floor and roof, between at least two unitary column/studs for extending the full height of the multi-storied building;

bolting one end of the spacer members to the first frame unit;

bolting first diagonal braces extending from the column/studs to the spacer members on the first frame unit;

erecting the first frame unit from the horizontal position into a vertical position;

anchoring the first frame unit to the foundation;

assembling a second frame unit in a substantially horizontal position by bolting a plurality of joists, one for each floor and roof, extending between a second pair of unitary column/studs for extending the full height of the multi-storied building;

erecting the second frame unit from the horizontal position into a vertical position adjacent to said first frame unit;

anchoring the second frame unit to the foundation;

bolting the other end of the spacer members of the first frame unit to the spacer members of the first frame unit;

assembling additional successive frame units in a substantially horizontal position and moving same into a vertical position for assembly to the previously erected frame unit until all frame units have been erected and spacer members have connected the frame units together;

laying a decking on each floor of the building;

laying a roof for the building;

installing non-load bearing studs; and affixing wall collateral board to said column/studs and non-load bearing studs.

* * * * *